United States Patent [19]

Paulet et al.

[11] 4,244,791

[45] Jan. 13, 1981

[54] ACIDIC ELECTROLYTE CONTAINING $Sn^{II}$ IONS

[75] Inventors: Jean F. Paulet, Siblingen; Bruno Boetsch, Schaffhausen, both of Switzerland

[73] Assignee: Swiss Aluminium Ltd., Chippis, Switzerland

[21] Appl. No.: 73,918

[22] Filed: Sep. 10, 1979

[30] Foreign Application Priority Data

Apr. 19, 1979 [CH] Switzerland ..... 3679/79

[51] Int. Cl.[3] ..... C25D 3/32

[52] U.S. Cl. ..... 204/54 R; 204/35 N

[58] Field of Search ..... 204/54 R, 54 L, 35 N, 204/43 S, 120; 106/1.25

[56] References Cited

U.S. PATENT DOCUMENTS

| | | | |
|---|---|---|---|
| 3,023,150 | 2/1962 | Willmund et al. | 204/44 |
| 3,075,899 | 1/1963 | Strauss et al. | 204/52 |
| 3,257,294 | 6/1966 | Michael | 204/45 |
| 4,073,701 | 2/1978 | Steinbicker | 204/54 R |

*Primary Examiner*—G. L. Kaplan
*Assistant Examiner*—William Leader
*Attorney, Agent, or Firm*—Bachman and LaPointe

[57] ABSTRACT

The object of this invention was to find a $Sn^{II}$-containing electrolyte for galvanizing or coloring anodized aluminum and its alloys which, in the first place, contains substances which stabilize $Sn^{II}$ better than substances used up to now for this purpose, secondly, exhibits better throwing power and therefore better current distribution and thirdly is not harmful to the environment, or at least not to such a degree as the electrolytes used up to now. The electrolyte of the invention is such that it contains one or more additives having the general structure $R_1$—S—$R_2$, where $R_1$ can be a hydrogen atom or a hydrocarbon group with or without a hydroxy or carboxy group, $R_2$ a hydrocarbon with hydroxy or carboxy group. A particularly preferred additive is 2.2'-di-hydroxy-di-ethyl-thio-ether (or 2.2'-thio-di-ethanol) $HOCH_2CH_2$—S—$CH_2CH_2OH$.

7 Claims, 2 Drawing Figures

ACIDIC ELECTROLYTE CONTAINING $Sn^{II}$ IONS

BACKGROUND OF THE INVENTION

The invention relates to an electrolyte used in particular for electroplating or for coloring anodized aluminum and its alloys and containing $Sn^{II}$ ions and additions which are able to stabilize the $Sn^{II}$ ions.

$Sn^{II}$ salts in the form of e.g. sulphates, fluorborates or chloride solutions are used in acidic electrolyte solutions both for electroplating aluminum and its alloys and for coloring these materials after anodizing.

It is known that the acidic sulphate bath is practically the only one which contains simple $Sn^{II}$ ions. In all other electrolytes the tin is at least partly bound up in a complex form.

One difficulty in electroplating or in coloring oxide layers in acidic solutions is that, during the process, the $Sn^{II}$ oxidizes to $Sn^{IV}$. By adding certain substances to the electrolyte the oxidation can be more or less suppressed i.e. the $Sn^{II}$ can be more or less stabilized.

The effectiveness of the stabilizing agent is decisive for the quality of the precipitate and therefore of the coloring of the oxide. It is generally known that the presence of both valency forms, $Sn^{II}$ and $Sn^{IV}$ ions, substantially impairs the quality of the surface treatment due to inadequate stabilizing of the $Sn^{II}$. It is therefore clear that one must endeavor to keep the tin in acidic solutions in the $Sn^{II}$ form.

The most frequently used stabilizers in acidic electrolytes are organic aromatic compounds—often sulphonic acids, which contain amino or phenol group e.g.:

phenolic sulphonic acid
divalent phenol: resorcinol, catechol, hydroquinone
amino-phenol
$\beta$-naphthol
dimethylaniline.

All of these compounds have, to a greater or lesser degree, a good stabilizing effect on $Sn^{II}$. They can not however completely prevent a pair of the $Sn^{II}$ oxidizing to $Sn^{IV}$. Consequently, the quality of the coloring of oxide layers on aluminum and its alloys is adversely affected. The depth of the dark color tones and the uniformity of the color is often difficult to achieve when the stabilizing of the $Sn^{II}$ ions is insufficient. This is a significant disadvantage of the stabilizers used up to now. An ideal stabilizer would be one which effects complete stabilization of the $Sn^{II}$ ions. In fact it is difficult to produce colors such as dark bronze or black for coloring anodized material, if using the above mentioned additions. Also, the throwing power of the electrolyte is unsatisfactory. This results in noticeably lighter and darker coloring of the edge zone. With progressive coloring time—after About 10 minutes—excessive coloring occurs and a metallic deposit is obtained on the surface, which then produces problems when cleaning the colored surface, contamination of the sealing baths and corrosion problems.

A further disadvantage of the substances employed to date as stabilizers for $Sn^{II}$ is their relatively high toxicity. The most widely used substances, the phenols, are particularly harmful to the environment. If they ever find their way into natural waters in large quantities, then the results are known to be very unpleasant. They are also difficult to break down biologically. In most countries therefore the environmental laws concerning phenols in waste waters are particularly strict. In Switzerland for example the upper limit for phenols tolerated in flowing waters is 0.05 mg/l. The limit for amines is 0.1 mg/l.

It is therefore an object of the invention to find an acidic electrolyte containing $Sn^{II}$ for coloring anodized aluminum and its alloys or for electroplating purposes, which, firstly contains substances with a better stabilizing effect on $Sn^{II}$ than those known up to now, secondly better throwing power and thus better distribution of current and thirdly is not harmful to the environment, or at least not to such a degree as those used to date, and overall satisfies best the various, to some extent contradictory, parameters.

SUMMARY OF THE INVENTION

Surprisingly, it was found that non-aromatic, aliphatic organic thio-compounds do not, or only to a much lesser degree, exhibit the above mentioned disadvantages of the agents used to data to stabilize $Sn^{II}$ in acidic solutions. These compounds are in particular saturated thio-alcohols or the thio-carboxylic acids derived therefrom and thio-ethers with the general structure $R_1$—S—$R_2$, in which $R_1$ is a hydrogen or a hydrocarbon with and without hydroxy or carboxy groups and $R_2$ stands for a hydrocarbon with hydroxy or carboxy groups.

DETAILED DESCRIPTION

Figure 1:
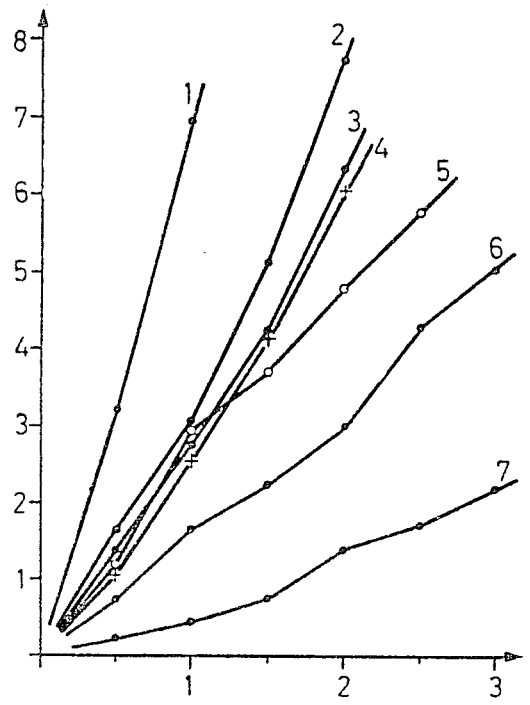
FIGS. 1 and 2 are graphs showing the stabilization of $Sn^{II}$ in an electrolyte by means of various additives wherein the abscissas are the time in hours and the ordinates are the loss of $Sn^{II}$ in grams per liter.

To be able to use these compounds in electrolyte baths they must of course be soluble under the given bath conditions. This considerably reduces the number of possible compounds which can be used, because, as is well known, the non-aromatic alcohols are increasingly insoluble with increasing length of chain. Compounds with 2 to 6 hydrocarbons have been found to be particularly advantageous. By using compounds from the group according to the invention, during the coloring of anodized aluminum, the flawsdue to excessive coloring in extended coloring times no longer occur. The problem of the often disadvantageous dark tone and the irregularity in the coloring, (which repeatedly occur when coloring in the presence of the known additions mentioned at the beginning) are considerably diminished or completely avoided by the new stabilizing compounds from the group according to the invention. The exceptionally good coloring properties apply not only to the limit color tones but especially in fact also to the dark tones which up to now were very difficult to achieve both in terms of depth and uniformly of color.

What is also surprising in the case of the group of compounds of the invention is the exceptional, up to now unattainable, stabilizing effect on $Sn^{II}$.

Of the group of compounds of the invention the following substances are particularly advantageous as additives:

| | |
|---|---|
| $HOOCCH_2$—S—$CH_2COOH$ | di-acetic acid-thio-ether (or thio-diglycolic acid). |
| HS—$CH_2CH_2OH$ | 2-thioethanol (or thioglycol). |
| $HOCH_2CH_2$—S—$CH_2CH_2OH$ | 2.2'-di-hydroxy-di-ethyl- |

-continued

| | |
|---|---|
| | thio-ether (or 2.2'-thio-di-ethanol), |
| $HOOCCH_2CH_2—S—CH_2CH_2COOH$ | 3.3'-di-propionic acid-thio-ether (or 3.3'-thio-di-propionic acid), |
| $HOOCCH_2—CH(SH)—COOH$ | thiomalic acid, |
| $HS—CH_2—CHOH—CH_2OH$ | thioglycerine. |

Of course, so that the advantages of the electrolyte of the invention over those used up to now can be recognized fully, all factors must be judged together viz., stabilizing effect on the $Sn^{II}$, throwing paper, current distribution, coloring effect, environmental problems.

The following two test series were carried out to demonstrate the exceptional stabilizing effect and the associated improved properties for coloring anodized aluminum in acidic solutions. The purpose here was to show the stabilizing effect of the additions of the invention by means of a quick test i.e. by flushing artificially with pure oxygen.

TEST SERIES 1

An aqueous electrolyte comprising 10 g/l $H_2SO_4$ and 20 g/l $SnSO_4$ was prepared. Under these conditions the tin is initially present as $Sn^{II}$. The electrolyte was then divided up into 5 containers of the same geometrical form. Each container held 1 liter of electrolyte.

Bath 1: no additions.

The other baths contained the following additions:

Bath 2: 20 g/l of paraphenolic sulphonic acid—an addition normally used up to now.

Bath 3: 20 g/l of a new addition in accordance with the invention viz., 3.3'-di-propionic acid-thio-ether (or 3.3'-thio-di-propionic acid), $$HOOCCH_2CH_2—S—CH_2CH_2COOH.$$

Bath 4: 10 g/l of thiomalic acid, $$HOOCCH_2—CH(SH)—COOH,$$

a new addition in accordance with the invention.

Bath 5: 20 g/l of thioglycerine, $$HS—CH_2—CHOH—CH_2OH,$$

a new addition in accordance with the invention.

Bath 6: 20 g/l of di-acetic acid-thio-ether (or thio-di-glycolic acid), $$HOOCCH_2—S—CH_2COOH,$$

a new addition in accordance with the invention.

Bath 7: 10 g/l of 2.2'-di-hydroxy-di-ethyl-thio-ether (or 2.2'-thio-diethanol), $$HOCH_2CH_2—S—CH_2CH_2OH,$$

a new addition in accordance with the invention.

In all baths the pH was equal to 1; the baths were at room temperature and were continually agitated by a magnetic stirrer. Each bath was flushed through a glass filter with 200 $cm^3$ of pure oxygen per minute and the $Sn^{II}$ content determined analytically every half hour. The results are presented in FIG. 1 wherein the abscissa represents the time in hours and the ordinate represents the loss of $Sn^{II}$ in grams per liter.

TEST SERIES 2

The same electrolyte solution as in the first series was prepared and likewise 1 liter of the solution poured into each container as above. The pH value in all baths was 1; the solutions were all at room temperature and were continually agitated by a magnetic stirrer.

Bath No. 8 corresponded to bath No. 1 in the first series and contained no additions. The other baths contained 2.2'-di-hydroxy-di-ethyl-thio-ether (or 2.2'-thio-diethanol) in the following amounts:

Bath 9: 3 g/l

Bath 10: 5 g/l

Bath 11: 10 g/l

Bath 11 corresponded therefore to bath 7 in the first series.

Figure 2:
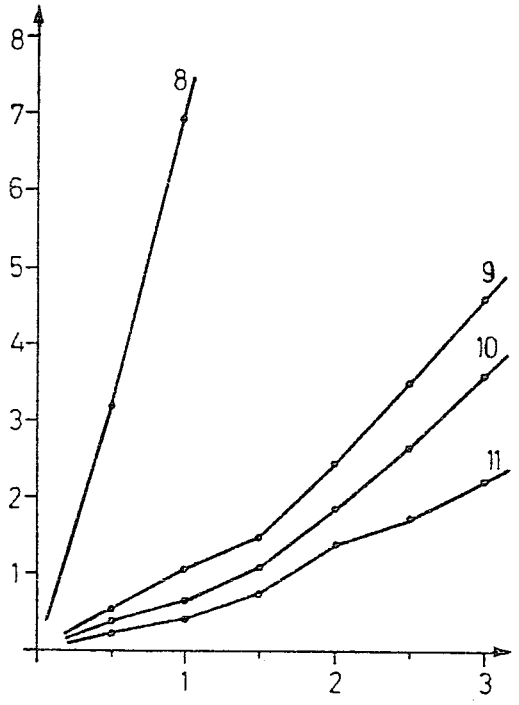

As in the first test series, each bath was flushed with 200 $cm^3$ of pure oxygen per minute, through a glass filter, and the $Sn^{II}$ content determined every half hour. The results are presented in FIG. 2 wherein the abscissa represents the time in hours and the ordinate represents the loss of $Sn^{II}$ in grams per liter.

It can be seen from both sets of results, that after only a relatively short time the greater part of the $Sn^{II}$ was transformed to $Sn^{IV}$ when no additions were made. It can also be seen that the stabilizing effect depends both on the substance added and the amount of substance added. In equal amounts the known additive paraphenolic sulphonic acid is much less efective in stabilizing $Sn^{II}$ than all the other additives. Even half the quantity of 2.2'-di-hydroxy-di-ethyl-thio-ether has a much better stabilizing effect than di-acetic acid-thio-ether, thioglycerine, thiomalic acid and 3.3'-di-propionic acid-thio-ether. Even 3 g/l of 2.2'-di-hydroxy-di-ethyl-thio-ether has a better stabilizing effect on $Sn^{II}$ than ca. seven times this amount i.e. 20 g/l of the known stabilizer additive paraphenolic sulphonic acid. On the other hand one finds in general that the larger the amount of additive given to the bath, the smaller is the loss of $Sn^{II}$.

COLORING TESTS

Coloring trails were carried out an anodized aluminum using 60 liter baths containing the electrolytes listed in Series 1 and 2 above and having in them the new additives in accordance with the invention. In each case the voltage was 16 V; the treatment time varied between 1 and 12 min. The samples were made of Peraluman 150 sheet (half hard) and measured $200 \times 300 \times 1.5$ mm. They were anodized via the normal direct current/$H_2SO_4$ method. The oxide layer was 20 $\mu m$ thick.

In the cases a completely uniform bronze color was obtained, free of edge effects. With the additives used up to now one often obtains an edge effect, in particular with bronze color tones. This is due to poor throwing power of electrolyte i.e. in the case of the $Sn^{II}$-containing electrolytes of the invention containing new additives, the throwing power is better than in the electrolytes used up to now for this purpose. The result is a better distribution of current and therefore more uniform coloring of the oxide layer.

A practical upper limit was set; this is not in fact intended as a restriction and was 50 g of stabilizer additive according to the invention for each liter of electrolyte. At this level a mixture or combination of the various stabilizing additives does not create problems. Quantities of 5 to 25 g however have been found to be advantageous.

If the amount of stabilizer substance in accordance with the invention exceeds 50 g/liter of electrolyte, as an individual compound, mixtures or combinations of compounds, then in the individual cases the coloring of the oxide layer can be impaired. The dark color tones are particularly affected.

Apart from the better stabilizing of $Sn^{II}$, the more uniform distribution of current and the consequently better coloring of anodized material, the new $Sn^{II}$-containing electrolyte of the invention has another significant advantage viz., that it is less damaging to the environment than the electrolyte used up to now, containing the additives for stabilizing $Sn^{II}$ listed at the start. The reason is that the new additives of the invention for stabilizing the $Sn^{II}$ ions can not give rise to phenol-type products which are particularly harmful to the environment.

What is claimed is:

1. Aqueous acidic electrolyte containing $Sn^{II}$ for coloring anodized aluminum and its alloys or electroplating the same, in which the said electrolyte contains an addition of soluble, non-aromatic, aliphatic organic thio-compounds to stabilize the $Sn^{II}$ ions, wherein the stabilizing agent is a compound selected from the group consisting of saturated thio-alcohols, thio-carboxylic acids derived therefrom, and thio-ethers, said compound having the general structure of $R_1—S—R_2$, wherein $R_1$ is selected from the group consisting of hydrogen, a hydrocarbon, a hydroxy-containing hydrocarbon and a carboxy-containing hydrocarbon, and $R_2$ is selected from the group consisting of a hydroxy-containing hydrocarbon and a carboxy-containing hydrocarbon.

2. Electrolyte according to claim 1 wherein said stabilizing agents contain from 2 to 6 carbon atoms.

3. Electrolyte according to claim 1, wherein the stabilizing agent is selected from the group consisting of

| | |
|---|---|
| $HOOCCH_2—S—CH_2COOH$ | di-acetic acid-thio-ether (or thio-diglycolic acid), |
| $HS—CH_2CH_2OH$ | 2-thioethanol (or thiogylycol), |
| $HOCH_2CH_2—S—CH_2CH_2OH$ | 2.2'-di-hydroxy-di-ethyl-thio-ether (or 2.2'-thio-di-ethanol), |
| $HOOCCH_2CH_2—S—CH_2CH_2COOH$ | 3.3'-di-propionic acid-thio-ether (or 3.3'-thio-di-propionic acid), |
| $HOOCCH_2—CH(SH)—COOH$ | thiomalic acid, |
| $HS—CH_2—CHOH—CH_2OH$ | thioglycerine, |

and mixtures thereof.

4. Electrolyte according to claim 1 wherein the stabilizing agent is selected from the group consisting of

| | |
|---|---|
| $HOOCCH_2—S—CH_2COOH$ | di-acetic acid-thio-ether (or thio-diglycolic acid), |
| $HOCH_2CH_2—S—CH_2CH_2OH$ | 2.2'-di-hydroxy-di-ethyl-thio-ether (or 2.2'-thio-di-ethanol), |
| $HOOCCH_2CH_2—S—CH_2CH_2COOH$ | 3.3'-di-propionic acid-thio-ether (or 3.3'-thio-di-propionic acid), |

and mixtures thereof.

5. Electrolyte according to claim 4 wherein the electrolyte is

| | |
|---|---|
| $HOCH_2CH_2—S—CH_2CH_2OH$ | 2.2'-di-hydroxy-di-ethyl-thio-ether (or 2.2'-thio-di-ethanol). |

6. Electrolyte according to claim 1 wher ein the stabilizing agents are present individually or in combination in amounts of 1 to 50 grams per liter of electrolyte.

7. Electrolyte according to claim 6 wherein the stabilizing agents are present individually or in combination in amounts of 5 to 25 grams per liter of electrolyte.

* * * * *

UNITED STATES PATENT AND TRADEMARK OFFICE

CERTIFICATE OF CORRECTION

PATENT NO. : 4,244,791

DATED : January 13, 1981

INVENTOR(S) : Jean Francois Paulet and Bruno Boetsch

It is certified that error appears in the above-identified patent and that said Letters Patent are hereby corrected as shown below:

In Column 1, line 32, change "group" to read ---groups---.

In Column 1, line 40, change "pair" to read ---part---.

In Column 1, line 54, change "About" to read ---about---.

In Column 2, line 18, change "data" to read ---date---.

In Column 2, line 45, change "flawsdue" to read ---flows due---.

In Column 2, line 54, change "limit" to read ---light---.

In Column 2, line 56, change "uniformly" to read ---uniformity---.

In Column 3, line 14, change "paper" to read ---power---.

In Column 4, line 32, change "efective" to read ---effective---.

In Column 4, line 45, change "trails" to read ---trials--- and change "an" to read ---on---.

In Column 4, line 55, change "the" to read ---all---.

In Column 5, line 7, delete "the", first occurrence.

In Column 5, line 16, change "electrolyte" to read ---electrolytes---.

In Column 6, line 5, claim 3, change "(or thiogylycol)," to read ---(or thioglycol),---.

Signed and Sealed this

*Ninth* Day of *June 1981*

[SEAL]

*Attest:*

RENE D. TEGTMEYER

*Attesting Officer* *Acting Commissioner of Patents and Trademarks*